US008221189B2

(12) United States Patent
Chen et al.

(10) Patent No.: US 8,221,189 B2
(45) Date of Patent: Jul. 17, 2012

(54) ATTACHABLE BREAST FORM ENHANCEMENT SYSTEM

(75) Inventors: David E. Chen, Walnut, CA (US); Jasper Chang, Diamond Bar, CA (US)

(73) Assignee: Bragel International, Inc., Pomona, CA (US)

( * ) Notice: Subject to any disclaimer, the term of this patent is extended or adjusted under 35 U.S.C. 154(b) by 267 days.

(21) Appl. No.: 12/533,360

(22) Filed: Jul. 31, 2009

(65) Prior Publication Data

US 2010/0029176 A1 Feb. 4, 2010

Related U.S. Application Data

(60) Provisional application No. 61/085,816, filed on Aug. 1, 2008.

(51) Int. Cl.
*A41C 3/00* (2006.01)

(52) U.S. Cl. ..... 450/81; 450/88; 450/54

(58) Field of Classification Search ..... 450/37–39, 450/54–58, 47, 49, 51, 52; 2/267, 268; 623/7, 623/8

See application file for complete search history.

(56) References Cited

U.S. PATENT DOCUMENTS

| | | | | |
|---|---|---|---|---|
| 817,020 | A | 4/1906 | Thompson | |
| 2,079,426 | A | 5/1937 | Schottenfels | |
| 2,342,076 | A * | 2/1944 | Herbener | 450/56 |
| 2,563,241 | A * | 8/1951 | Herbener | 450/55 |
| 2,579,365 | A | 12/1951 | Conde | |
| 2,728,079 | A | 12/1955 | Williams | |
| 2,793,369 | A | 5/1957 | Panighini | |
| 2,834,352 | A * | 5/1958 | Ullian | 450/57 |
| 2,844,151 | A | 7/1958 | Lemons | |
| 2,869,553 | A | 1/1959 | D'Or | |
| 2,882,905 | A | 4/1959 | Barg | |
| 3,196,878 | A | 7/1965 | Hedu | |
| 3,280,818 | A | 10/1966 | Pankey et al. | |

(Continued)

FOREIGN PATENT DOCUMENTS

DE 0216441 7/1961

(Continued)

OTHER PUBLICATIONS

Abstract and Figures Only for French Patent No. 2505620 (Nov. 19, 1982).

(Continued)

*Primary Examiner* — Gloria Hale

(74) *Attorney, Agent, or Firm* — Christie, Parker & Hale, LLP

(57) ABSTRACT

A backless, strapless breast form system to be worn in place of a traditional bra including a pair of breast forms, wherein each breast form includes a volume of silicone gel encased between thermoplastic film material; an interior surface adapted to be attached to a user's breast, wherein substantially an entire interior surface from edge to edge comprises a pressure sensitive adhesive layer and wherein the interior surface has a plurality of bumps adapted to increase a push up effect of the breast form; a lateral side adapted to face the user's armpit and a medial side facing opposite the lateral side, wherein the breast form is adapted to be secured to the user's breast solely by the pressure sensitive adhesive layer; and a connector adapted to adjoin the pair of breast forms, wherein the connector is positioned between the medial side of each of the pair of breast forms.

20 Claims, 5 Drawing Sheets

U.S. PATENT DOCUMENTS

| | | | | |
|---|---|---|---|---|
| 3,297,036 | A | 1/1967 | Williams | |
| 3,556,107 | A | 1/1971 | Brumfield | |
| 3,749,102 | A | 7/1973 | Wynants | |
| 3,814,107 | A * | 6/1974 | Greenblatt et al. | 450/56 |
| 3,834,397 | A * | 9/1974 | Birch | 450/56 |
| 3,934,593 | A | 1/1976 | Mellinger | |
| 4,553,550 | A | 11/1985 | Hattori | |
| 4,992,074 | A | 2/1991 | Diaz | |
| 5,352,307 | A | 10/1994 | Wild | |
| 5,538,502 | A | 7/1996 | Johnstone | |
| 5,755,611 | A | 5/1998 | Noble et al. | |
| 5,792,292 | A | 8/1998 | Wild | |
| 5,922,023 | A | 7/1999 | Mulligan et al. | |
| D419,279 | S | 1/2000 | Marco et al. | |
| 6,200,195 | B1 | 3/2001 | Furuno et al. | |
| 6,231,424 | B1 | 5/2001 | Valentin | |
| 6,257,951 | B1 | 7/2001 | DeMarco | |
| 6,257,952 | B1 | 7/2001 | Valentin | |
| 6,283,820 | B1 | 9/2001 | Huang | |
| 6,758,720 | B2 * | 7/2004 | Chen | 450/57 |
| 6,780,081 | B2 * | 8/2004 | Chen et al. | 450/81 |
| 6,824,444 | B2 * | 11/2004 | Huang | 450/57 |
| 6,852,001 | B2 * | 2/2005 | Chen et al. | 450/57 |
| 6,914,224 | B2 * | 7/2005 | Gillner et al. | 219/522 |
| 7,052,359 | B2 * | 5/2006 | Chen et al. | 450/54 |
| 7,144,296 | B2 * | 12/2006 | Chen et al. | 450/81 |
| 7,922,560 | B2 * | 4/2011 | Avalos-Dessner et al. | 450/39 |
| 2001/0021620 | A1 | 9/2001 | DeMarco | |
| 2001/0027079 | A1 | 10/2001 | Valentin | |

FOREIGN PATENT DOCUMENTS

| | | | |
|---|---|---|---|
| FR | 989453 | A | 9/1951 |
| FR | 1092914 | | 4/1955 |
| GB | 0785851 | | 11/1957 |
| GB | 2208785 | A | 4/1989 |
| KR | 10-0419298 | | 2/2004 |

OTHER PUBLICATIONS

Figures Only for Italian Patent No. IT 0521811 (May 1955).

Dr. Leonard's—America's Leading Discount Healthcare Catalog, p. 15, Natural Looking Breast Enhancer Pads, Silicone Covered with Film, 1998.

* cited by examiner

ATTACHABLE BREAST FORM ENHANCEMENT SYSTEM

CROSS-REFERENCE TO RELATED APPLICATION

This application claims priority to and the benefit of U.S. Provisional Application No. 61/085,816, filed on Aug. 1, 2008, at the United States Patent and Trademark Office, the entire content of which is incorporated herein by reference.

FIELD OF THE INVENTION

The present invention relates to an attachable breast form enhancement system, and more specifically to an attachable breast form enhancement system having an adhesive layer for adjoining to a user's skin.

BACKGROUND OF THE INVENTION

Various devices and methods are available to women who wish to enhance their breasts. Generally, women can either undergo a surgical procedure to be fitted with a breast implant, or can use some form of externally worn article. Such externally worn devices include a wide range of foam pads, pushup bras, gelled breast inserts to be worn between the user's breast and a bra, and other breast form enhancement systems. However, such externally worn devices do not necessarily afford the user the look and feel of a natural breast, but rather look unnatural and feel foreign.

SUMMARY

In accordance with embodiments of the present invention, a breast form enhancement system is provided that can create varying degrees of breast enhancement while remaining inconspicuous under clothing.

In one embodiment, a backless, strapless breast form system to be worn in place of a traditional bra is provided including a pair of breast forms. Each breast form includes a volume of silicone gel encased between thermoplastic film material and an interior surface adapted to be attached to a user's breast, wherein the interior surface includes a pressure sensitive adhesive layer and wherein the interior surface has a plurality of bumps adapted to increase a push up effect of the breast form. Each breast form has a lateral side adapted to face the user's armpit and a medial side facing opposite the lateral side, wherein the breast form is adapted to be secured to the user's breast solely by the pressure sensitive adhesive layer, and a connector adapted to adjoin the pair of breast forms, wherein the connector is positioned between the medial side of each of the pair of breast forms.

In one embodiment, a first bump and a second bump are spaced from each other such that a channel is formed between the first bump and the second bump, the channel oriented to permit fluid to drain down along the interior surface of the respective breast form. Further, each of the plurality of bumps may be spaced from an edge of the breast form.

In one embodiment, at least one of the breast forms has an upper portion and a lower portion and each of the plurality of bumps may be located primarily in the lower portion of the breast form. Additionally, each of the plurality of bumps may be integral with the breast form. Further, the interior surface of each breast form may have a generally concave shape and each of the plurality of bumps may have a generally convex shape.

In another embodiment, a single breast form as described above may be used independently if desired and does not need to be used in conjunction with a second breast form.

In yet another embodiment of the present invention, a method of using an adjustable backless, strapless breast form system is provided, the method including independently positioning a pair of breast forms over each of a user's breasts, wherein each breast form has a generally concave interior surface adapted for placement over the user's breasts and includes a plurality of bumps adapted to increase a push up effect of the respective breast, and a volume of silicone gel encased between thermoplastic film material. The method further includes adjoining a pressure sensitive adhesive layer disposed along the interior surface of each of the breast forms to a desired position on the user's breasts, wherein the pressure sensitive adhesive layer of each breast form is sufficiently readily removed from the user's breast independently of the other breast form to be repositionable relative to the user's breast and to the adjacent breast form and adjoining the breast forms together by engaging a connector positioned between inner sides of each of the breast forms, wherein the connector has a first portion attached to a medial side of one of the breast forms and a second portion attached to a medial side of the other breast form, wherein the first portion and the second portion are adapted to cooperatively engage.

In one embodiment, each of the pair of breast forms are secured to the user's breast by only the pressure sensitive adhesive layer. Further, the method may include increasing the distance between the medial sides of the pair of breast forms before they are adjoined together to increase the amount of breast cleavage created when the breast forms are adjoined together or decreasing the distance between the medial sides of the pair of breast forms before they are adjoined together to decrease the amount of breast cleavage created when the breast forms are adjoined together.

DETAILED DESCRIPTION

Figure 1:
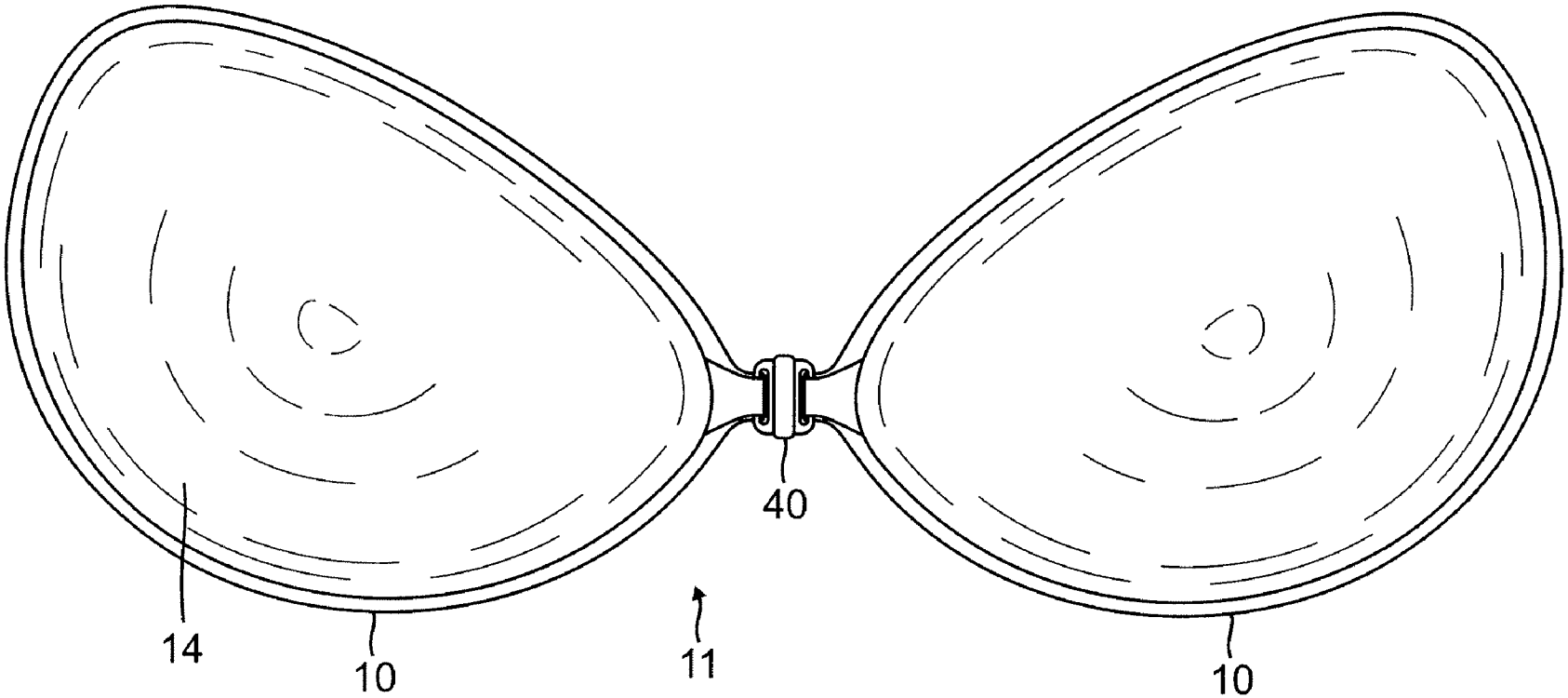
FIG. 1 is a schematic front view of a breast form system having a pair of breast forms attached by a connector.

Breast form enhancement systems constructed according to principles of this invention generally comprise a pair of breast forms or bra cups 10 adjoined by an enhancement connector 40 to form a breast form system 11, as shown in FIG. 1. Exemplary breast form enhancement systems are shown and described in, for example, U.S. Pat. No. 6,758,720 (Chen), U.S. Pat. No. 6,780,081 (Chen et al.), and U.S. Pat. No. 6,852,001 (Chen et al.), all of which are incorporated herein by reference.

Figure 4:
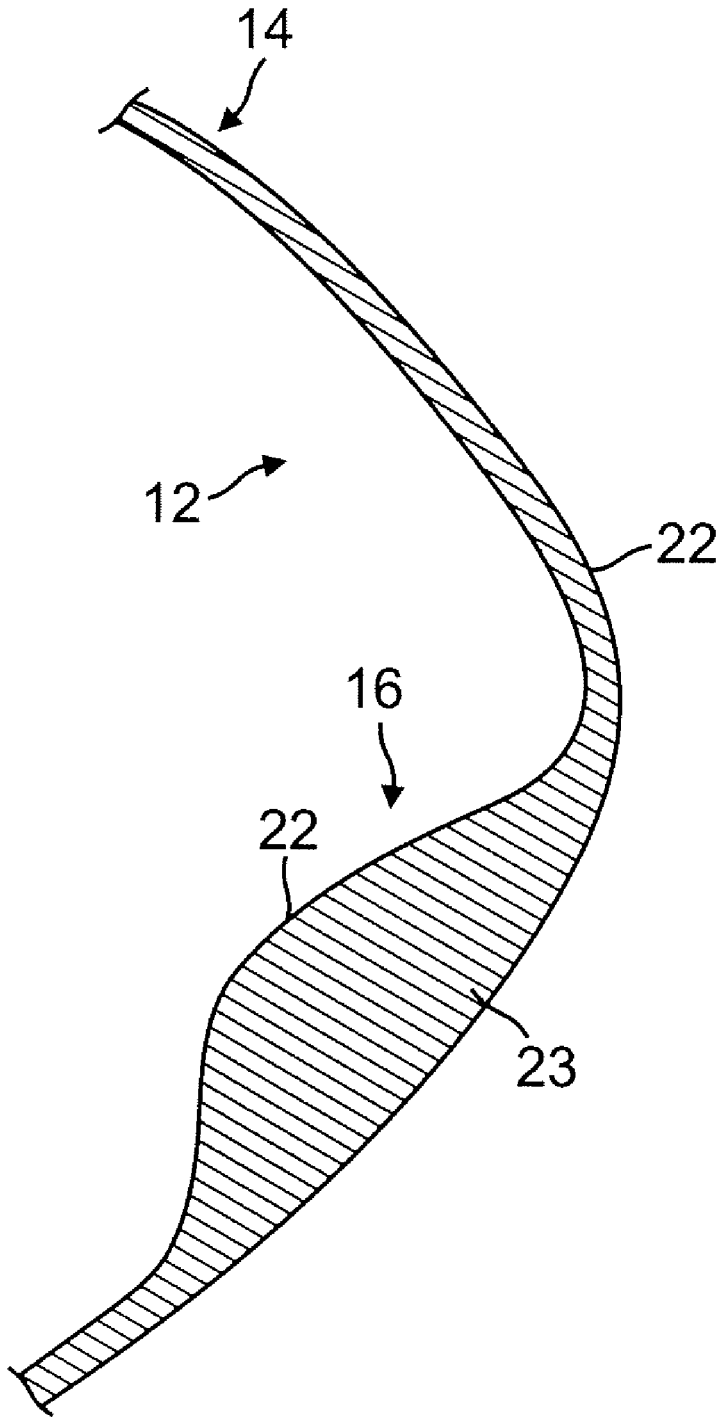
FIG. 4 is a schematic side cross-sectional view taken along the line IV-IV of FIG. 3 of one embodiment of a breast form.
Figure 5:
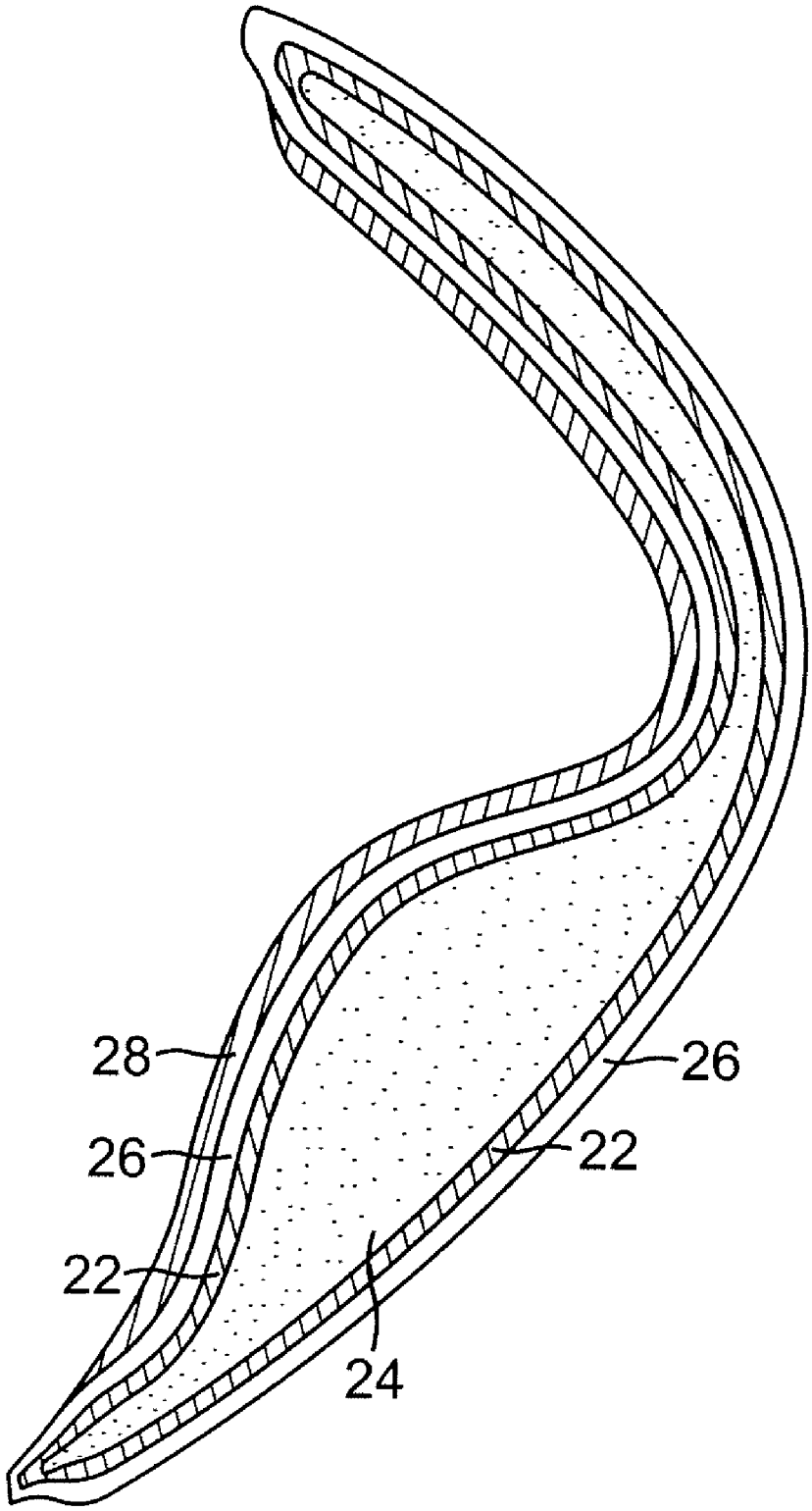
FIG. 5 is a detailed side cross-sectional view taken along the line IV-IV of FIG. 3 of another embodiment of a breast form showing layers of the breast form.

As shown in FIG. 1 and also in FIGS. 4 and 5, an exterior surface of each breast form 10 is substantially smooth like a normal bra cup, and therefore the breast form is not more apparent or conspicuous than a regular bra when worn under an article of clothing.

Figure 2:
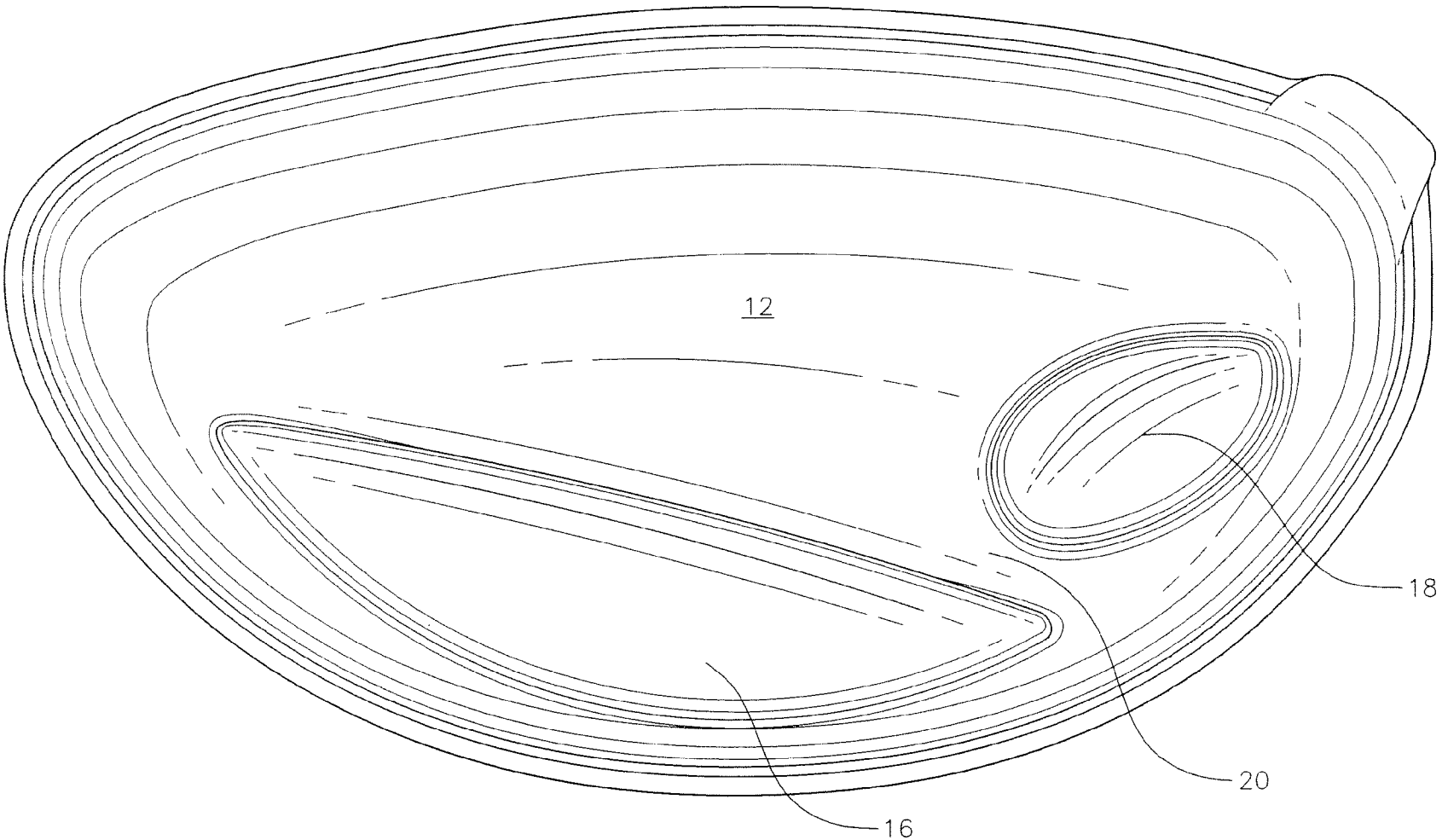
FIG. 2 is a schematic perspective view of the back of a breast form according to an embodiment of the present invention.

With reference also to FIG. 2, the breast forms 10 are separate articles that are independently placed on a left and right breast of a user. The breast forms 10 generally have a mirror-image configuration, one designed to support and enhance the left breast and one designed to support and enhance the right breast. The breast forms 10 each have a pressure sensitive adhesive layer, as described in more detail below, that enables the breast forms to be removably attached to each of a user's left and right breasts.

Generally, the user of the breast form system 11 positions the pressure sensitive adhesive layer of each of the breast forms 10 on the left and right breasts, and then adjoins the breast forms to each other by engaging the connector 40. The user can create varying degrees of breast cleavage and breast push-up enhancement depending on where the breast forms are positioned on the user's breasts and how much the connector 40 pulls the two breast forms towards each other. Furthermore, the placement of the connector 40 relative to the top and bottom of the breast forms will impact the degree of cleavage and push-up enhancement. Accordingly, the breast form system 11 enables the user to position the breast forms at a position that creates a desired breast shape, and also allows the user to control the amount of cleavage and push-up enhancement by adjoining the breast forms with the connector.

The breast form system 11 can be formed from several different types of breast forms 10. The breast forms 10 are intended to include all types of externally worn articles that can be worn to enhance or replace a user's breasts. These include, but are not limited to, breast forms made from a volume of silicone gel encased by a thermoplastic film material. The breast forms also include any liquid, air, or gel encased by any foam, plastic, rubber, fabric, or molded unwoven fiber material, as well as any solid material that is suitable for external breast enhancement, such as a foam, soft rubber, fabric, molded unwoven fiber, or plastic. Accordingly, it is understood that a wide range of materials, structures, and sizes are within the scope of the breast forms 10 for purposes of this invention.

Figure 3:
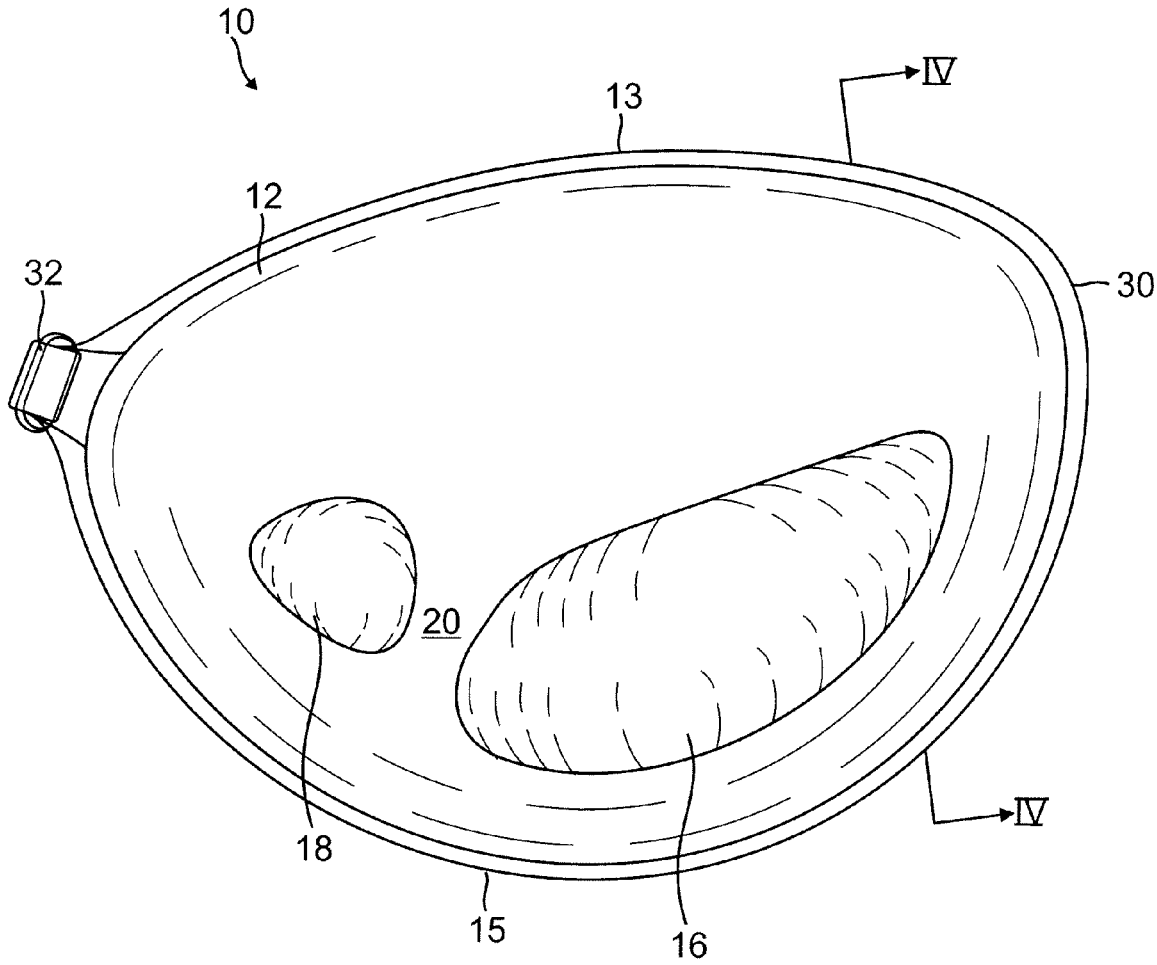
FIG. 3 is a schematic plan back view of the breast form of FIG. 1.

A perspective view of the back of a breast form 10 is shown in FIG. 2 and a plan back view of a breast form 10 is shown in FIG. 3. Each breast form 10 defines two surfaces relative to a user, an interior surface 12 facing toward the user's breasts and an exterior surface 14 (FIG. 1) facing away from the user's breasts. The breast form also defines a top 13, a bottom 15, a lateral side 30 closer to the user's adjacent arm, and a medial side 32 opposite the lateral side. The interior surface 12 comprises a pressure sensitive adhesive layer 28 (FIG. 5) that adjoins the breast forms to the user's skin.

The pressure sensitive adhesive layer 28 can include any type of pressure sensitive adhesive (PSA) that is suitable for removably attaching a breast form to a user's skin, such as various types and forms of double-sided tape and permanently grown PSAs. The pressure sensitive adhesive layer 28 allows the user to place each of the breast forms at a position on the user's breasts that will create a desired shape and look of the breasts. The amount and type of PSA comprising the pressure sensitive adhesive layer 28 can vary, as can the portions of the interior surface that have the pressure sensitive adhesive layer. Various factors can contribute to the amount, type, and placement of the pressure sensitive adhesive layer such as the size, shape, and weight of the breast form.

In one embodiment, the pressure sensitive adhesive layer 28 is a re-usable PSA that is permanently grown to the interior surface 12 of each breast form from edge to edge. Unlike known adhesives, the pressure sensitive adhesive layer 28 will not readily shift once it is positioned on the user and can be re-used repeatedly without losing its adhesive properties. The pressure sensitive adhesive layer 28 has an adhesion force to the breast forms 10 that is greater than a cohesion force to the user's skin. The pressure sensitive adhesive layer is further able to withstand tremendous movement and pressure from the user without slipping and can even be subjected to water or sweat without degeneration of the adhesive properties. In fact, if the pressure sensitive adhesive layer becomes dirty (i.e., collects unwanted particles such as dust, lint, or debris), it can be cleaned with soap and water to remove the unwanted particles and substantially restore the adhesive properties.

The breast forms 10 are each adapted to accommodate the connector 40. The connector 40 can have many different forms, but generally will have two or more separate portions, where a first portion attaches to one breast form and a second portion attaches to the other breast form. The first and second portions of the connector are designed to engage each other in order to adjoin the two breast forms 10. Furthermore, the separate portions of the connector 40 can be either permanently or removably attached to the breast forms. It is also possible for the connector 40 to be a single unit that removably attaches to both breast forms. The manner in which the connector 40 attaches to the breast forms will vary depending on the particular structures of the breast forms and the connector.

The breast form system 11 shown in FIG. 1 can represent various combinations of breast forms 10 and connectors 40. In one embodiment, as shown in FIG. 4, each of the breast forms 10 includes a volume of silicone gel material 23 encased within a flexible thermoplastic film material 22, such as polyurethane or the like. The thermoplastic film material 22 can be in the form of two separate sheets that are heat sealed together along a perimeter surface where the interior surface 12 and the exterior surface 14 meet. Additionally, the breast forms can further comprise an optional fabric layer 26 (FIG. 5) that is permanently joined to the thermoplastic film material.

The fabric layer 26 and thermoplastic film material 22 are permanently and inseparably adjoined by heat lamination or other similar processes. Referring to FIG. 5, a detailed side cross-sectional view of another embodiment of the breast form 12 is shown, wherein the breast form has two sheets of thermoplastic film material 22 encasing a volume of foam 24, the two thermoplastic film material sheets 22 being heat sealed along the perimeter of the breast form 10. One or both of the sheets 22 also has an optional fabric layer 26. The fabric layer 26 may be permanently adjoined to one sheet 22 such that the fabric layer faces toward a user's breast or away from a user's breast when the breast form is applied to the breast. Alternatively, if desired, the fabric layer 26 can be adjoined to both sheets 22, as shown in FIG. 5. The pressure sensitive adhesive layer 28 is permanently grown to the fabric layer 26. The fabric layer 26 can be made from any suitable material, such as a two-way or four-way stretchable material that allows the breast form to conform to the user's breast shape. It will be appreciated that the thermoplastic film material 22, and optionally the fabric layer 26, can encompass the silicone gel 23, the foam 24, or any other suitable material.

With reference also to FIGS. 3-5, the interior surface 12 of the breast form is generally concave to conform to the shape of the user's breast. However, in one embodiment, the interior surface 12 includes a pair of convex raised sections or bumps 16, 18 spaced from each other. In general, the bumps 16, 18 are dimensioned and oriented to improve the pushup effect of the breast form 10, yet to not significantly detract from the ability of the breast form to be attached to and maintained on a user's breast. As such, the bumps 16, 18 may be primarily located in a lower half of the breast form 10, yet are spaced sufficiently from the bottom 15 and lateral and medial sides 30, 32 to allow a periphery of the breast form to be adequately attached to the user's skin. As shown in the figures, the lateral bump 16 is larger than the medial bump 18, although it will be appreciated that the bumps may be the same size or the medial bump may be larger than the lateral bump.

With reference to FIG. 3, the first bump 16 is located closer to the lateral side 30 of the breast form 10 and the second bump 18 is located closer to the medial side 32 of the breast form. In one embodiment, the first bump 16 has a generally ovular shape with a lower periphery extending generally along and spaced from a lower edge of the breast form 10, thereby maintaining a sufficiently concave surface area along the lower edge of the breast form to be attached to the user's breast. In one embodiment, the lower periphery of the first bump 16 is spaced from the lower edge of the breast form 10 by about 0.5 inch. The upper periphery of the first bump 16 may extend from between about a 45 degree angle to about a 15 degree angle in the medial-to-lateral direction depending on the amount of pushup effect desired. In one embodiment, the first bump 16 has a height of between about 0.25 inch and about 0.5 inch. Further, the first bump 16 may have an area of about 1 $in^2$ to about 3 $in^2$.

In one embodiment, the second bump 18 has a generally circular shape with a lower periphery spaced from the lower edge of the breast form 10 similarly to the first bump to maintain a sufficiently concave surface area along the lower edge of the breast form to be attached to the user's breast. In one embodiment, the second bump 18 has a height of between about 0.1 inch and about 0.4 inch and has an area of about 0.5 $in^2$ to about 1.0 $in^2$. While specific locations, orientations, quantities and sizes of the first and second bumps 16, 18 have been shown and described herein, it will be appreciated that any or all of these characteristics may be modified within the scope and spirit of the present invention.

The second bump 18 is spaced from the first bump 16 to create a channel 20 between the first bump and the second bump. The channel 20 is configured to allow perspiration to drain from between the user's skin and the breast form 10 so as not to collect on the breast form which may not only cause discomfort, but may also reduce the ability of the breast form to adjoin to the skin. Additionally, the channel allows for ventilation of the breast form 10 to cool the user's skin and therefore adds to the user's comfort.

If not integral with the breast form, the bumps may be configured to be attachable to the inner surface of the breast form so that a user can position the bumps as desired for that user's desired effect. For example, the attachable bumps may have a convex surface that would generally conform to the concave surface of a breast form and an opposite surface configured to provide uplift to a breast once the bump is in place. Such bumps may or may not themselves have adhesive on their outer surfaces. In addition, a set of attachable bumps of varying size and shape may be provided for selection and application to the concave inner surface by the user.

With reference now to FIGS. 4 and 5, the first bump 16 is shown formed only on the interior surface 12 of the breast form 10, while the exterior surface 14 remains relatively smooth so as to remain inconspicuous under the user's clothing. The materials and methods used to construct the breast form 10, including the bumps, may vary. One method that might be employed is that shown and described in U.S. Pat. No. 5,693,164 (Chang), which is incorporated herein by reference. In one embodiment with reference to FIG. 4, the breast form includes two sheets of thermoplastic film 22 encasing a volume of silicone gel 24. More specifically, the two sheets of thermoplastic film 22 may be inserted into a mold generally defining the exterior shape of the breast form 10, including the bumps 16, 18. Then, the silicone gel 24 is inserted between the sheets of thermoplastic film 22 to fill the mold. Once the silicone gel 24 is cured, the bumps 16, 18 are permanently formed in the breast form 10. The breast form is not limited to silicone gel forming the bumps, and other suitable materials, such as foam (FIG. 5), may also be used.

A fabric 26 may cover and be permanently attached to one or both of the sheets of thermoplastic film 22. The fabric can comprise any suitable material, such as a two-way or four-way stretchable material that allows the breast form to conform to the user's breast shape. The pressure sensitive adhesive 28 may be applied to the fabric 26 during the manufacturing process so as to be permanently in place. A reusable and/or washable adhesive may also be used.

While the present invention has been described in connection with certain exemplary embodiments, it is to be understood that the invention is not limited to the disclosed embodiments, but, on the contrary, is intended to cover various modifications and equivalent arrangements included within the spirit and scope of the disclosure. For example, it will be appreciated that only a single bump may be formed on the interior surface, or that three or more bumps may be formed. Additionally, many different types of adhesives, such as double-sided tape, may be used, as well as various filler materials for the bumps substituting for the silicone gel.

What is claimed is:

1. A backless, strapless breast form system to be worn in place of a traditional bra comprising:

a pair of breast forms, wherein each breast form comprises:

a volume of silicone gel encased between thermoplastic film material;

an interior surface adapted to be attached to a user's breast, wherein an interior surface comprises a pressure sensitive adhesive layer and wherein the interior surface has a plurality of bumps adapted to increase a push up effect of the breast form, the plurality of bumps comprising a first bump and a second bump spaced from each other such that a channel is formed between the first bump and the second bump, the channel extending to a lower edge of the breast form and being generally concave along its extent; and a lateral side adapted to face the user's armpit and a medial side facing opposite the lateral side, wherein the breast form is adapted to be secured to the user's breast solely by the pressure sensitive adhesive layer; and a connector adapted to adjoin the pair of breast forms, wherein the connector is positioned between the medial side of each of the pair of breast forms.

2. The breast form system of claim 1, wherein the channel is oriented to permit fluid to drain down along the interior surface of the respective breast form.

3. The breast form system of claim 1, wherein each of the plurality of bumps is spaced from the lower edge of the breast form to maintain a sufficiently concave surface area along the lower edge of the breast form to be attached to the user's breast.

4. The breast form system of claim 1, wherein at least one of the breast forms has an upper portion and a lower portion and wherein each of the plurality of bumps is located primarily in the lower portion of the breast form.

5. The breast form system of claim 1, wherein each of the plurality of bumps is integral with the breast form.

6. The breast form system of claim 1, wherein the interior surface of each breast form has a generally concave shape and wherein each of the plurality of bumps has a generally convex shape.

7. The breast form system of claim 1, wherein one of the plurality of bumps has an area of between about 1 $in^2$ and about 3 $in^2$.

8. The breast form system of claim 7, wherein another one of the plurality of bumps has an area of between about 0.5 $in^2$ and about 1.0 $in^2$.

9. The breast form system of claim 1, wherein substantially an entire interior surface from edge to edge of each respective breast form comprises a pressure sensitive adhesive layer.

10. A breast form to be worn in place of a traditional bra cup, the breast form comprising:

a volume of silicone gel encased between thermoplastic film material;

an interior surface adapted to be attached to a user's breast, wherein an interior surface comprises a pressure sensitive adhesive layer, wherein the interior surface has a plurality of bumps adapted to increase a push up effect of the breast form, and wherein each of the plurality of bumps is spaced from a lower edge of the breast form to maintain a sufficiently concave surface area along the lower edge of the breast form to be attached to the user's breast; and a lateral side adapted to face the user's armpit and a medial side facing opposite the lateral side, wherein the breast form is adapted to be secured to the user's breast solely by the pressure sensitive adhesive layer.

11. The breast form system of claim 10, wherein the plurality of bumps comprise a first bump and a second bump spaced from each other such that a channel is formed between the first bump and the second bump, the channel oriented to permit fluid to drain down along the interior surface of the breast form.

12. The breast form system of claim 10, wherein the breast form has an upper portion and a lower portion and wherein each of the plurality of bumps is located primarily in the lower portion of the breast form.

13. The breast form system of claim 10, wherein each of the plurality of bumps is integral with the breast form.

14. The breast form system of claim 10, wherein the interior surface of the breast form has a generally concave shape and wherein each of the plurality of bumps has a generally convex shape.

15. A method of using an adjustable backless, strapless breast form system, the method comprising:

independently positioning a pair of breast forms over each of a user's breasts, wherein each breast form comprises a generally concave interior surface adapted for placement over the user's breasts and comprising a plurality of bumps adapted to increase a push up effect of the respective breast, wherein each of the plurality of bumps is spaced from a lower edge of the breast form to maintain a sufficiently concave surface area along the lower edge of the breast form to be attached to the user's breast, and a volume of silicone gel encased between thermoplastic film material;

adjoining a pressure sensitive adhesive layer disposed along the interior surface of each of the breast forms to a desired position on the user's breasts, wherein the pressure sensitive adhesive layer of each breast form is sufficiently readily removed from the user's breast independently of the other breast form to be repositionable relative to the user's breast and to the adjacent breast form; and adjoining the breast forms together by engaging a connector positioned between inner sides of each of the breast forms, wherein the connector comprises a first portion attached to a medial side of one of the breast forms and a second portion attached to a medial side of the other breast form, wherein the first portion and the second portion are adapted to cooperatively engage.

16. The method of claim 15, wherein each of the pair of breast forms are secured to the user's breast by only the pressure sensitive adhesive layer.

17. The method of claim 15, further comprising increasing the distance between the medial sides of the pair of breast forms before they are adjoined together to increase the amount of breast cleavage created when the breast forms are adjoined together.

18. The method of claim 15, further comprising decreasing the distance between the medial sides of the pair of breast forms before they are adjoined together to decrease the amount of breast cleavage created when the breast forms are adjoined together.

19. The method of claim 15, wherein the plurality of bumps comprise a first bump and a second bump spaced from each other such that a channel is formed between the first bump and the second bump, the channel oriented to permit fluid to drain down along the interior surface of the respective breast form.

20. The breast form of claim 10, wherein the plurality of bumps comprise a first bump and a second bump spaced from each other such that a channel is formed between the first bump and the second bump, the channel extending to the lower edge of the breast form and being generally concave along its extent.

* * * * *